US005305470A

United States Patent [19]

McKay

[11] Patent Number: 5,305,470

[45] Date of Patent: * Apr. 26, 1994

[54] SPORTS BAND

[76] Inventor: William D. McKay, 528 Kelso St., Flint, Mich. 48506

[ * ] Notice: The portion of the term of this patent subsequent to Jun. 9, 2009 has been disclaimed.

[21] Appl. No.: 762,849

[22] Filed: Sep. 16, 1991

Related U.S. Application Data

[63] Continuation-in-part of Ser. No. 712,141, Jun. 5, 1991, Pat. No. 5,119,513.

[51] Int. Cl.[5] ..... A42C 5/00

[52] U.S. Cl. ..... 2/7; 2/171; 2/171.2; 2/170; 2/DIG 11; 607/109; 607/111

[58] Field of Search ..... 2/7, 170, 171, 171.2, 2/181, 196, 209.1, 411, 413, 425, DIG. 11; 128/402

[56] References Cited

U.S. PATENT DOCUMENTS

| | | | |
|---|---|---|---|
| 1,567,931 | 12/1925 | Epler | 128/402 |
| 4,055,188 | 10/1977 | Pelton | 128/402 |
| 4,133,055 | 1/1979 | Zebuhr | 2/411 |
| 4,326,533 | 4/1982 | Henderson | 128/402 |
| 4,468,817 | 9/1984 | Nunnery | 2/DIG. 11 |
| 4,484,363 | 11/1984 | Varanese | 2/181 |
| 4,521,922 | 6/1985 | Mitchell | 2/DIG. 11 |
| 4,576,169 | 3/1986 | Williams | 128/402 |
| 4,645,498 | 2/1987 | Kosak | 128/403 |
| 4,742,581 | 5/1988 | Rosenthal | 2/170 |
| 4,776,042 | 10/1988 | Hanson | 2/7 |
| 4,805,619 | 2/1989 | Swearingen | 128/402 |
| 4,815,144 | 3/1989 | Martin | 2/7 |
| 4,833,734 | 5/1989 | Der Estephanian | 2/170 |
| 4,843,653 | 7/1989 | Coble | 2/170 |
| 4,896,378 | 1/1990 | Campana | 2/170 |
| 4,918,758 | 4/1990 | Rendina | 2/DIG. 11 |
| 5,054,122 | 10/1991 | Sher | 2/7 |
| 5,088,549 | 2/1992 | Schneider | 2/7 |
| 5,119,513 | 6/1992 | McKay | 2/170 |

*Primary Examiner*—Clifford D. Crowder
*Assistant Examiner*—Diana L. Biefeld
*Attorney, Agent, or Firm*—Stetina and Brunda

[57] ABSTRACT

A sports band for absorbing perspiration and for cooling the wearer is comprised of a band of elastic absorbent material, generally toroidal in shape, and is configured to be worn upon a person's head or wrist. The sports band has a slit formed upon its inner surface such that a flexible cold pack may be received thereby and disposed within the band. The sports band may alternatively be generally comprised of a comparatively inelastic material and have a strip of elastic material inserted as a portion of the band to provide the required stretchability. A layer of insulating material may optionally be formed along the inner layer of the generally toroidal band to reduce the rate of heat transfer between the wearer and the cold pack such that the sensation of cold is reduced and the useful life of the cold pack is increased. Alternatively, the insulating layer may substantially enclose the cold pack to further reduce the rate of heat transfer from the environment to the cold pack and thus further increase the useful life of the cold pack.

5 Claims, 2 Drawing Sheets

Fig. 1
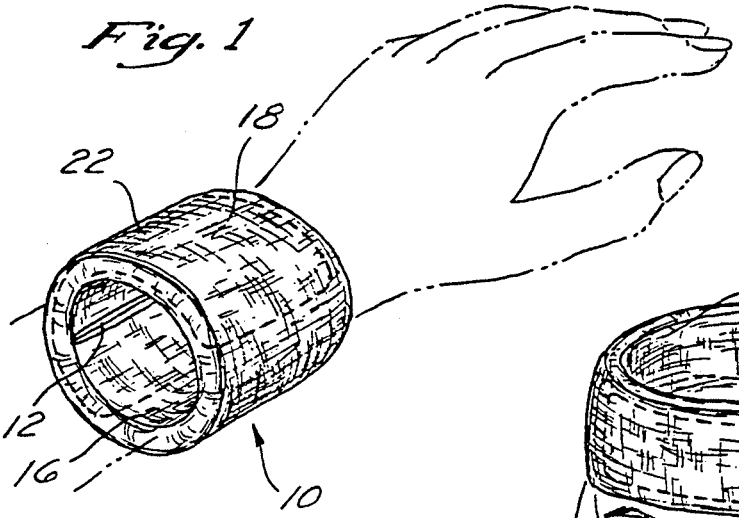
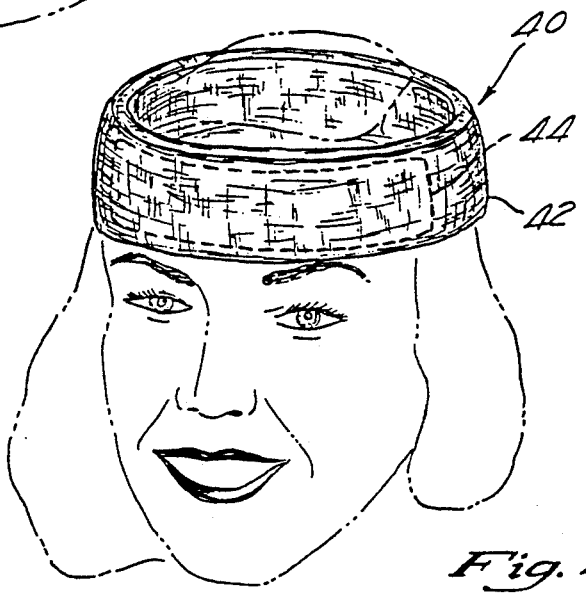
Fig. 4
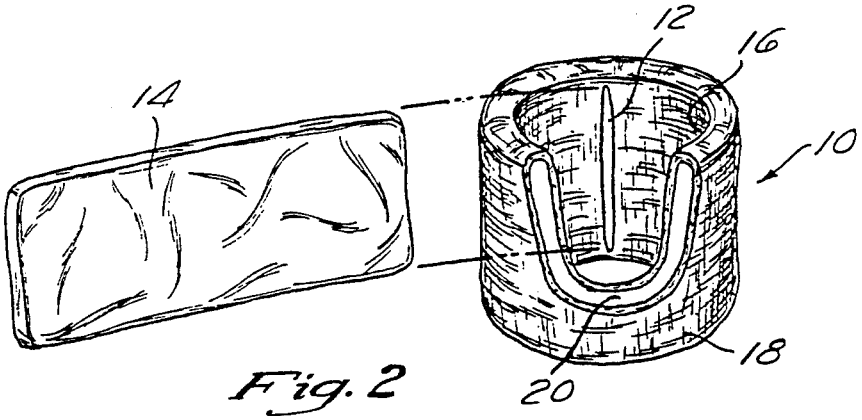
Fig. 2
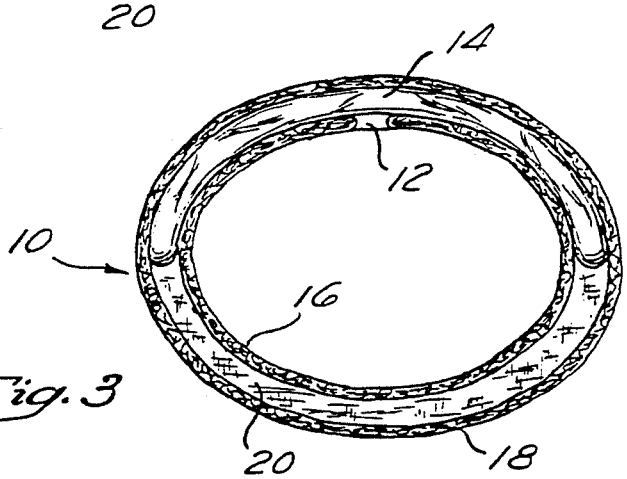
Fig. 3

Fig. 5
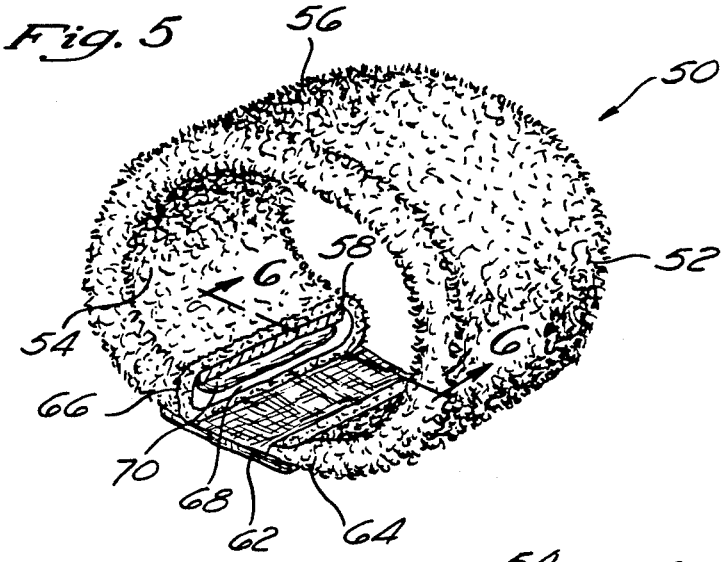
Fig. 6
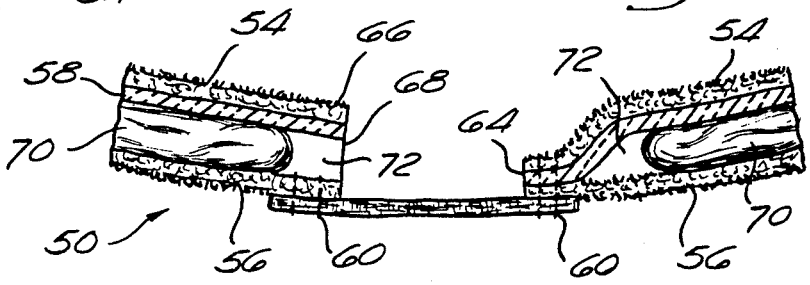
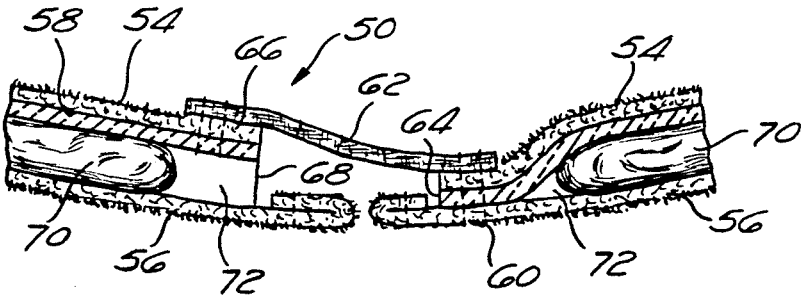
Fig. 7
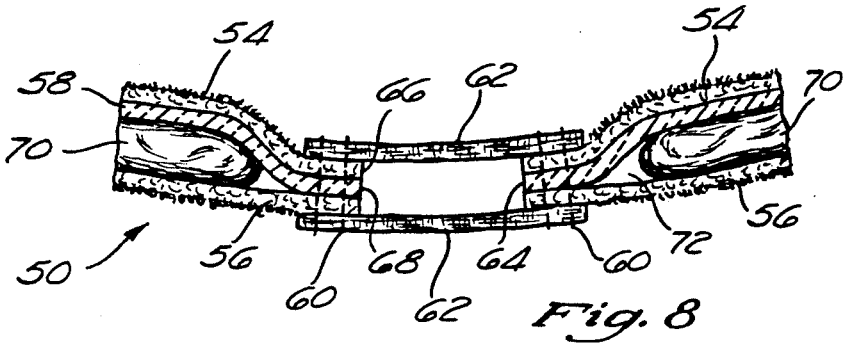
Fig. 8

SPORTS BAND

RELATED APPLICATIONS

This application is a continuation-in-part of U.S. patent Ser. No. 07/712,141, filed on Jun. 5, 1991, now U.S. Pat. No. 5,119,513, presently copending and incorporated herein by reference.

FIELD OF THE INVENTION

The present invention relates generally to sports apparel and more particularly to a sports band for absorbing perspiration and for cooling the wearer. The sports band is either comprised of a hollow band of elastic absorbent material or a hollow band of inelastic material having an elastic material forming a small section thereof. It is generally toroidal in shape and configured to be worn upon a person's head or wrist. The band has a slit formed upon either its inner or outer surface such that a flexible cold pack may be received thereby and disposed within the band.

BACKGROUND OF THE INVENTION

Head bands and wrist bands worn during sports, such as tennis and volleyball, are well known. Such bands are commonly worn to absorb perspiration, thereby preventing perspiration from contacting the user's eyes and/or hands where it may potentially interfere with the user's performance. Such contemporary bands typically comprise elastic terry cloth or the like which is configured to snugly encircle the wearer's wrist or the upper portion of the user's head.

Flexible cold packs for use in therapeutic applications, such as to reduce swelling and inflammation resulting from sprained joints, are likewise well known. Such cold packs typically comprise a freezable gel disposed within a liquid-impenetrable bag which may be cooled to a temperature below the freezing point of water without becoming rigid. Such cold packs typically have a comparatively high heat capacity such that they may be placed in contact with an anatomical portion f the user's body for a prolonged period of time, i.e. 15–45 minutes, before the cooling effect is lost.

Overheating of the participants during sporting events is common, particularly on hot and/or humid days. Participants frequently attempt to cool themselves by applying a water spray to their bodies such that evaporative cooling will occur. However, this technique is not particularly effective when the humidity is high. Other techniques, such as drinking cold liquids, may affect the user's performance and possibly present health risks.

No means of providing a cooled band for use in sports is presently known. Additionally, no means is presently known for maintaining contact of a therapeutic cold pack with an anatomical portion of a user's body during sports activities.

As such, although the prior art has recognized to a limited extent the problems of absorbing perspiration during sporting events and of cooling the participants, the proposed solutions have to date been ineffective in providing a satisfactory remedy. Thus, it would be desirable to provide a sports band which would both absorb the user's perspiration and provide cooling to the user.

SUMMARY OF THE INVENTION

The present invention specifically addresses and alleviates the above-mentioned deficiencies associated in the prior art. More particularly, the present invention comprises a sports band for absorbing perspiration and for cooling the wearer. In a first embodiment, the sports band is comprised of a band of elastic absorbent material, generally hollow and toroidal in shape and configured to be worn upon a person's head or wrist. It has a slit formed upon its inner surface such that a flexible cold pack may be received thereby and disposed within the band.

In a second embodiment the sports band is comprised of a band of comparatively inelastic absorbent material, hollow and generally toroidal in shape, and configured to be worn upon a person's head or wrist. The relatively inelastic absorbent material does not form a complete toroid, but rather is cut completely through at one point such that two ends of the inelastic material are defined. A strip of expandable or elastic fabric connects the two ends together to complete the band and facilitate stretching thereof. The flexible or elastic fabric is preferably sewn to both the upper and lower portions of the inelastic material at one end thereof, and to only the upper portion at the opposite end thereof. By sewing only to the upper portion of the inelastic material at the opposite end thereof, an aperture is formed therein such that a flexible cold pack may be received thereby and disposed within the band. Thus, use of the expandable or elastic material facilitates the use of a comparatively non-stretchable fabric for the generally toroidal portion of the band.

Optionally, a second layer of fabric or other flexible heat-insulating material may be disposed along the bottom layer of the generally toroidal fabric band to provide additional insulation between the cold pack and the wearer. This additional insulating layer reduces the rate at which heat is absorbed by the cold pack and thus both reduces the sensation of cold felt by the wearer and increases the useful life of the cold pack.

Alternatively, the insulating layer may be formed along both the top and bottom surfaces of the generally toroidal fabric such that the cold pack will be substantially enclosed therein and thus thermally insulated from both the wearer and the environment. This additional insulation further prolongs the useful life of the cold pack by limiting heat transfer from the environment thereto.

Thus, a user may wear the sports band of the present invention to improve performance by both absorbing perspiration and cooling the user. The perspiration is thereby prevented from interfering with the user's performance. Cooling the user improves both the user's comfort and ability to perform.

These, as well as other advantages of the present invention, will be more apparent from the following description and drawings. It is understood that changes in the specific structure shown and described may be made within the scope of the claims without departing from the spirit of the invention.

BRIEF DESCRIPTION OF THE DRAWINGS

FIG. 1 is a perspective view of a first embodiment of a sports band, constructed of an elastic material, the sports band being configured to be worn upon a user's wrist;

FIG. 2 is a perspective view of a cold pack as it is about to be inserted into the sports band of FIG. 1;

FIG. 3 is a cross-sectional view of a sports band showing a cold pack disposed therein;

FIG. 4 is a perspective view of a sports band according to the present invention configured to be worn upon a user's head;

FIG. 5 is a perspective view of a second embodiment of the sports band, constructed of a relatively inelastic material and having an expandable or elastic portion attaching the two ends thereof;

FIG. 6 is a cross-sectional view of the two ends of the sports band taken along lines 6—6 of FIG. 5 wherein the elastic portion is attached to the outer layers thereof, better illustrating the insulating layer formed along the inner surface thereof and attachment of the elastic strip;

FIG. 7 is a cross-sectional view of the two ends of the sports band wherein the elastic portion is attached to the inner layers thereof; and FIG. 8 is a cross-sectional view of the two ends of the sports band wherein the elastic portion is attached to both the inner and outer layers thereof.

DETAILED DESCRIPTION OF THE PREFERRED EMBODIMENT

The detailed description set forth below in connection with the appended drawings is intended as a description of the presently preferred embodiments of the invention, and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The sports band of the present invention is illustrated in FIGS. 1-8 which depict two presently preferred embodiments of the invention. Referring now to FIGS. 1-3, a first embodiment of the sports band 10 is comprised generally of a band 22 of an elastic absorbent material, preferably stretch terry cloth, i.e. terry cloth having elastic fibers formed therein. An opening or slit 12, preferably formed upon the inner wall 16 provides access to the void or pocket 20 (as shown in FIG. 3) formed between the inner 16 and outer 18 walls thereof. The band 22 is configured to fit snugly upon the user's wrist such that perspiration forming upon the user's forearm will be absorbed thereby rather than travel down to the user's hand where it might affect performance.

A cold pack 14 (best shown in FIG. 2) is configured to be received through slot 12 and into the pocket 20 where it may be used to cool the wearer. Those skilled in the art will recognize that various cold packs are available and suitable for use in the practice of the present invention. Such cold packs typically comprise a gel which remains flexible after being cooled to below the freezing point of water. The gel is contained within a plastic or other bag. Such cold packs are commonly used to liquid-impenetrably administer therapy to injured or sprained joints, and in the treatment of arthritis and bruised muscles.

The cold pack 14 is disposed between the inner 16 and outer 18 walls of the band 22. The walls 16 and 18 insulate the cold pack 14 from the user and the external environment to help maintain the cool temperature thereof. The inner wall 16 provides a degree of insulation between the user and the cold pack 14 such that heat transfer is thereby regulated and the user therefore does not perceive the cold pack 14 as being excessively cold.

Referring now to FIG. 4, the first embodiment of the sports band 40 of the present invention is configured to fit upon the upper portion of a user's head such that it crosses the forehead. The cold pack 44, contained therein in the manner of the first embodiment, is preferably positioned across the forehead of the user.

The bands 22 and 42 of the first are preferably comprised of a terry cloth or terry cloth-like material having elastic properties along at least the longitudinal axis thereof such that the band may be stretched sufficiently to be worn snugly upon the wrist or head. Those skilled in the art will recognize that various materials and/or combinations of materials are likewise suitable.

Referring now to FIGS. 5 and 6, a second embodiment of the sports band 50 of the present invention is comprised of a band 52 of comparatively inelastic material formed in a generally toroidal configuration having outer or top 56 and inner or bottom 54 layers. The comparatively inelastic band is split completely through at one point such that first 64 and second 66 ends are defined. An elastic strip 62 is attached, preferably via sutures 60, to the first 64 and second 66 ends such that the band 50 may be stretched as occurs when the band is put on and removed and also in order to accommodate a range of wrist and head sizes. The elastic strip 62 is preferably approximately ½-inch long and preferably of the same width as the band 50.

The elastic strip 62 is preferably sewn to the first end 64 such that the top 56 and bottom 54 layers of the relatively inelastic material are sewn together in a manner which closes the first end 64 of the band 50. The elastic strip 62 is preferably sewn only to the upper layer 56 of the relatively inelastic material such that an opening 68 is formed therein. A cold pack 70 may be received through the opening 68 and disposed within the void 72 formed between the upper 56 and lower 54 surfaces of the band 50, as in the first embodiment.

Optionally, a layer of insulating material 58 may be formed along the inside of the lower surface 54 to further insulate the wearer from the cold pack 70. This both reduces the sensation of cold to the wearer and increases the useful life of the cold pack 70 by reducing heat transfer from the wearer to the cold pack 70. Alternatively, the insulating layer 58 may be formed along both the lower 54 and upper 56 layers such that the cold pack 70 is substantially surrounded by the insulating layer 58 to further insulate the cold pack 70 from the environment. Insulating the cold pack 70 from the environment further increases the useful life of the cold pack 70 by reducing heat transfer from the environment to the cold pack 70.

Referring now to FIG. 7, the elastic strip 62 may alternatively be sewn to the inside or bottom layer 54 of the relatively inelastic material. Thus, the opening 68 is consequently disposed on the outside in an exposed manner when the band 50 is worn.

Referring now to FIG. 8, the elastic strip 62 may alternatively be sewn to both the lower 54 and upper 56 layers of relatively inelastic material, such that no openings are formed at the first 64 and second 66 ends of the band 50. In this instance, an opening (not shown) may be formed elsewhere upon the band, either in the lower 54 or upper 56 layer. Alternatively, the cold pack 70 may be permanently sewn within the band 50 and no opening provided.

It is understood that the exemplary sports bands described herein and shown in the drawings represent only presently preferred embodiments of the invention. Indeed, various modifications and additions may be made to such embodiments without departing from the spirit and scope of the invention. For example, the sports band need not be limited to the simple toroid shape described and illustrated, but rather may be of any shape suitable for covering a substantial portion of the user's anatomy. Indeed, the sports band of the present invention need not be limited to use wherein it is worn upon the user's wrist and/or head. Rather, those skilled in the art will recognize that various portions of the anatomy may be suitable for such use. Thus, these and other modifications and additions may be obvious to those skilled in the art and may be implemented to adapt the present invention for use in a variety of different applications.

What is claimed is:

1. A sports band for absorbing perspiration and for cooling the wearer, said band comprising;

(a) a band of non-elastic absorbent material, generally toroidal in shape and configured to be worn upon one of a person's head and a person's wrist, said band being cut completely through at one point thereof such that a first end and a second end are formed; and (b) an elastic strip, wherein said elastic strip is sewn to said first end of said inelastic material such that said first end is closed and is sewn to said second end of said inelastic material such that said second end is open and can receive a cold pack therethrough.

2. The sports band as recited in claim 1 further comprising a flexible cold pack configured to be received within said band.

3. A sports band and cold pack combination comprising:

(a) a band of absorbent material configured to be worn by a person, said band generally comprised of an inelastic material and further comprising an elastic strip inserted into said band to permit stretching thereof;

(b) a pocket formed within said band;

(c) a cold pack configured to be received within said pocket; and (d) wherein said elastic strip is sewn to a first end of said inelastic material such that said first end is closed and is sewn to a second end of said inelastic material such that said second end is open and can receive said cold pack therethrough.

4. The sports band and cold pack combination as recited in claim 3 wherein said inelastic material is cut completely therethrough at one point therealong such that first and second ends thereof are defined, said elastic strip being attached to said first and second ends of said inelastic material.

5. The sports band and cold pack combination as recited in claim 4 wherein said elastic strip is sewn to said first and second ends of said inelastic material.

* * * * *